United States Patent [19]

Lamarque

[11] 4,357,485

[45] Nov. 2, 1982

[54] LADLE STEEL TREATMENT SYSTEM INCLUDING THREE-PART ELECTRODE CASING

[75] Inventor: Gabriel Lamarque, Paris, France

[73] Assignee: Heurtey Metallurgie, Paris, France

[21] Appl. No.: 154,140

[22] Filed: May 29, 1980

[30] Foreign Application Priority Data

Jun. 6, 1979 [FR] France ..... 79 14396

[51] Int. Cl.[3] ..... H05B 7/102

[52] U.S. Cl. ..... 373/95; 373/91; 373/102

[58] Field of Search ..... 13/12,14–18, 13/9, 9 ES, 13

[56] References Cited

U.S. PATENT DOCUMENTS

| | | | |
|---|---|---|---|
| 1,267,976 | 5/1918 | Cobb | 13/9 |
| 2,368,998 | 2/1945 | Nissim | 13/9 |
| 2,662,104 | 12/1953 | Southern | 13/31 |
| 2,889,386 | 6/1959 | Gruber | 13/13 |
| 3,614,284 | 10/1971 | Scheidig et al. | 13/13 |

FOREIGN PATENT DOCUMENTS

| | | | |
|---|---|---|---|
| 52-6145 | 1/1977 | Japan | 13/9 |

*Primary Examiner*—B. A. Reynolds
*Assistant Examiner*—Bernard Roskoski
*Attorney, Agent, or Firm*—Wenderoth, Lind & Ponack

[57] ABSTRACT

A steel treatment system includes a ladle having a cover, a heating electrode mounted to extend through an opening in the cover, a casing surrounding the electrode and including lower, intermediate and upper sections, and a seal mounted at the cover about the opening for forming a seal with the lower section of the casing. A clamp device is mounted on the intermediate section of the casing and extends therethrough for clamping the electrode and for fixing the relative axial position of the electrod with respect to the casing. An actuator is fixedly supported at a level above the clamp device and is operatively connected to the casing to move the casing and the electrode downwardly. First guide rollers act on the lower section of the casing, and second guide rollers act on the upper section of the casing for ensuring axial movement of the casing and electrode.

8 Claims, 4 Drawing Figures

LADLE STEEL TREATMENT SYSTEM INCLUDING THREE-PART ELECTRODE CASING

BACKGROUND OF THE INVENTION

The present invention relates to improvements in ladle steel treatment systems.

It is known that ladle steel treatment systems are designed notably with a view to reheat the metal to be treated while it is shielded from air or any other oxidizing atmosphere. Therefore, such a system must be so constructed that the ladle proper, its cover, and possibly its container as well as the electrode receiving recesses or pits, constitute a unitary, sealed assembly.

Moreover, systems of this character must meet, inter alia the following requirements:

1 -since the electrode receiving recesses, pits or casings must be capable of moving vertically through the ladle cover or the ladle container, the fluid-tightness of the passageways provided for these recesses involve the use of drive and guide means which must undergo a minimum of distortion when heated;

2 - since the electrodes, consisting in general of a plurality of commercially available sections fitting into one another by means of nipples, are enclosed completely in their casings, some steps must be taken to prevent the breakage of the electrode in actual service, for example as a consequence of excessive electrodynamic stress. In fact, a broken electrode is likely to dip partially into the molten metal bath, thus delaying considerably the treatment operation and causing the loss of the ladle contents, an incipient solidification of the metal, and also serious damage to the equipment.

SUMMARY OF THE INVENTION

It is the primary object of the present invention to provide a system capable of minimizing the distortion of the component elements thereof by reducing lever arms and providing efficient, reliable axial guide means.

It is another object of this invention to minimize the length of the electrode shaft, in order to impart a maximum strength thereof under electrodynamic stress.

It is a complementary object of this invention to improve the safety of the equipment, in case of electrode breakage.

The ladle steel treatment system according to this invention is characterized in that each heating electrode is disposed within a sealed casing made of several sections comprising means for axially guiding the electrodes during their movements, in that the movements of the electrodes are controlled by an actuator overlying the electrode clamp, and that protection means are associated with the electrodes, whereby, in case of electrode breakage, the main circuit-breaker is triggered when a stray current flows between the clamp and the electrode casing portion containing the operative portion of the electrode.

According to the present invention, the fluid-tight casing enclosing each heating electrode consists of three sections, namely a lower portion constituting a water jacket, where fluid-tightness is achieved, an intermediate section including the electrode clamp with its electrode holding device, and an upper section constituting a reserve chamber in which the inoperative portion of the electrode is housed.

According to a specific feature characterizing this invention, the means for axially guiding the electrodes comprise, on the one hand, insulating rollers engaging the lower portion of the electrode casing, which overlie the sealing means, and, on the other hand, rollers mounted to bear against the upper portion of the electrode casing.

According to another feature of the invention, the piston rod of the electrode driving actuator is secured at the level of the electrode clamp or of the high-current connection, and the actuator body is secured to a platform supported by the frame structure rigid with the ladle cover.

According to a complementary feature of this invention, the body or cylinder of each actuator controlling the electrode movements is secured at the level of the electrode clamp or of the high-current connection, and its piston rod is mounted to a platform carried by the frame structure rigid with the ladle cover.

BRIEF DESCRIPTION OF THE DRAWINGS

Other features and advantages of the ladle steel treatment system of this invention will appear as the following description proceeds, with reference to the attached drawings illustrating diagrammatically a typical embodiment of the invention, and wherein.

DETAILED DESCRIPTION OF THE INVENTION

Figure 1:
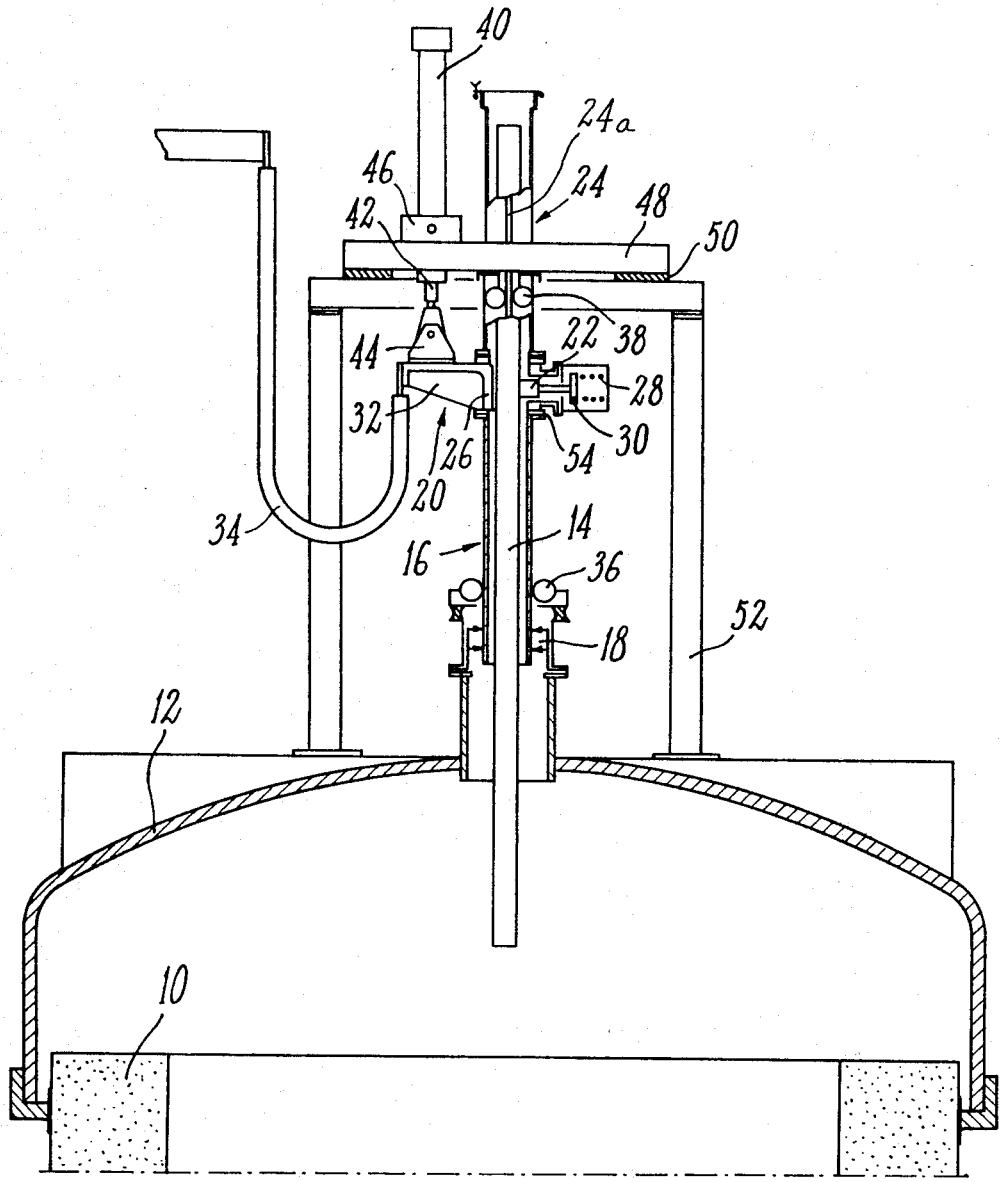
FIG. 1 is a diagrammatic side-elevational and axial sectional view of a system constructed according to the teachings of the invention.

In the exemplary embodiment illustrated in FIG. 1, the improved ladle steel treatment system according to this invention comprises a ladle 10 provided with a cover 12 having mounted therethrough one of the heating electrodes, shown at 14. This electrode 14 is housed in a casing comprising three sections, namely:

- a lower section 16, by which fluid-tightness is obtained, for example, by the sealing means shown diagrammatically at 18;
- an intermediate section 20, consisting essentially of a water-cooled holding device 22, with a control means to be described presently; and,
- an upper section 24, constituting a reserve chamber enclosing the inoperative portion of electrode 14 which is adapted, in a known fashion, to be lowered in a clamp as its operative tip wears out, the consumption of a complete electrode section entailing the fixing of a new electrode section by means of a nipple, according to a conventional procedure.

The electrode clamp comprises the holding device consisting of a push member 22 urged by a coil compression spring 28 to press the electrode 14 against a clamp body 26. This elastic pressure is adapted to be counteracted by a built-in actuator 30 when it is desired or necessary to release the electrode. The electrode clamp further comprises a connecting bracket or like member 32, to which one end of flexible current supply cables 34 are connected, the other end of these cables 34 being connected to a heating transformer.

The means contemplated, according to this invention, for guiding the electrode with a minimum distortion of the system, now will be described in detail. These guide means comprise, on the one hand, rollers 36 lined with a suitable insulating material, which bear against the lower portion 16 of the electrode casing and which are disposed above the ring supporting the packings or like seals 18, and, on the other hand, other rollers 38, mounted to guide the upper portion 24 of the electrode casing by running against track 24*a* thereof. With these lower and upper sets of rollers, the electrode casing is properly guided in the axial direction of the electrode.

The electrode 14 is adapted to be moved along its axis by an actuator 40, having a piston rod 42 coupled, via a strap 44, to the bracket 32, with the interposition of a suitable insulating element. The actuator cylinder is supported, with the interposition of a universal joint 46, by a platform 48. This platform 48 is mounted, in turn, with the interposition of vibration absorbing means 50, on a frame structure 52 supported by the ladle cover or container 12. The guide rollers 38 are also mounted on this platform 48.

Figure 2:
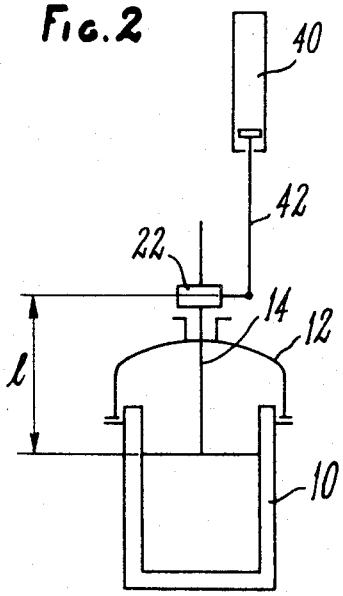
FIG. 2 is a diagrammatic elevational and sectional view of the system illustrated in FIG. 1.
Figure 3:
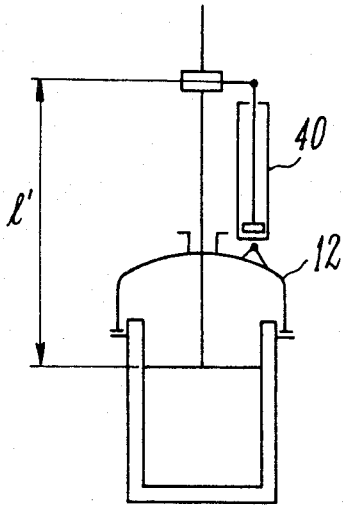
FIG. 3 is a view similar to FIG. 2, but of a conventional system.

In the above-described example referring to FIG. 1, the piston rod 42 of actuator 40 extends downwardly, and, therefore, the cylinder does not partake in the piston stroke. Consequently, when the holding clamp 26 is in its lowermost position, it can approach as close as possible the ring provided with the packings or seals 18. As clearly illustrated in FIG. 2, with this arrangement, it is possible to reduce the length 1 of the electrode-containing casing with respect to the value assumed by this length 1' (FIG. 3) when the cylinder 40 is supported directly by the cover 12 of the ladle or container 10. Other things being equal, and the critical electrode breaking moment depending on the useful length of the electrode casing, it is obvious that the strength of the assembly will be improved considerably with the arrangement of this invention.

Figure 4:
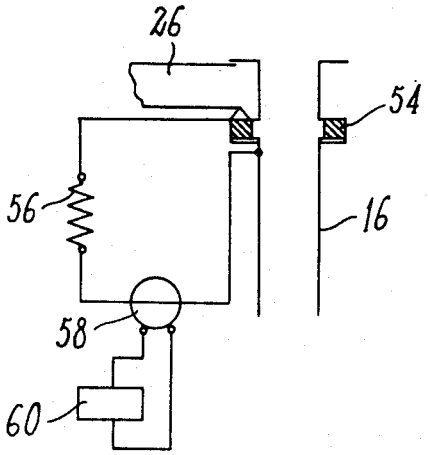
FIG. 4 illustrates diagrammatically the protection means according to this invention, which become operative in case of electrode breakage.

Finally, the present invention also provides safety means which become operative in case of electrode breakage (FIG. 4).

This safety means comprises a ring 54 of insulating material for insulating the clamp 26 from the electrode casing section 16. Between the clamp and this casing section, an electric circuit, comprising a limiting resistor 56, a transformer 58 and a current relay 60, is disposed. In case of electrode breakage, if the unclamped electrode section contacts the casing section 16, electric current will flow through this circuit and energize the winding of relay 60, thus opening the main circuit breaker almost instantaneously. Thus, any risk of bursting by stray arcing the cooled section 16 of the electrode casing is safely avoided.

Although a specific embodiment of this invention has been described hereinabove and illustrated in the attached drawings, it will readily occur to those skilled in the art that various modifications and changes may be made thereto without departing from the scope of the invention, as set forth in the appended claims.

What I claim is:

1. A steel treatment system comprising:

a ladle adapted to contain steel to be treated and having a cover;

a heating electrode mounted to extend through an opening in said cover;

a casing surrounding said electrode and including a lower section, an intermediate section and an upper section;

seal means, mounted on said cover about said opening, for forming a seal with said lower section of said casing and thereby for fluid-tightly isolating said electrode from the surrounding atmosphere;

clamp means, mounted on said intermediate section of said casing and extending therethrough, for clamping said electrode and for fixing the relative axial position thereof with respect to said casing;

actuator means, fixedly supported at a level above said clamp means and operatively connected to said casing, for moving said casing and said electrode downwardly such that new length portions of said electrode may be passed through said opening into said ladle; and first guide means acting on said lower section of said casing and second guide means acting on said upper section of said casing for ensuring axial movement of said casing and said electrode.

2. A system as claimed in claim 1, wherein said first guide means comprise first rollers supported by said seal means and bearing against outer surfaces of said lower section of said casing, and said second guide means comprise second rollers supported at a fixed position and bearing against outer surfaces of said upper section of said casing.

3. A system as claimed in claim 1, further comprising a frame supported by said cover and having a platform portion at a position above said clamp means, said actuator means being fixed to said platform portion and to said clamp means at said intermediate portion of said casing.

4. A system as claimed in claim 3, wherein said actuator means comprises a piston-cylinder assembly including a piston connected to said clamp means and a cylinder connected to said platform portion.

5. A system as claimed in claim 3, wherein said actuator means comprises a piston-cylinder assembly including a piston connected to said platform portion and a cylinder connected to said clamp means.

6. A system as claimed in claim 3, wherein said first guide means comprise first rollers supported by said seal means and bearing against outer surfaces of said lower section of said casing, and said second guide means comprise second rollers supported by said platform portion and bearing against outer surfaces of said upper section of said casing.

7. A system as claimed in claim 1, further comprising safety means, connected to said lower and intermediate sections of said casing, for detecting breakage of said electrode and for terminating a supply of electrode current thereto.

8. A system as claimed in claim 7, wherein said safety means comprises an electrical circuit, connected across said lower and intermediate sections and including a limiting resistor, a transformer and a current relay, for detecting current between said lower and intermediate sections as a result of electrode breakage.

* * * * *